US006100993A

United States Patent [19]

Eom

[11] Patent Number: 6,100,993

[45] Date of Patent: Aug. 8, 2000

[54] APPARATUS FOR DETECTING AMOUNT OF PAPER REMAINING IN PAPER CASSETTE OF PRINTER

[75] Inventor: Yoon-seop Eom, Suwon, Rep. of Korea

[73] Assignee: Samsung Electronics Co., Ltd., Kyungki-Do, Rep. of Korea

[21] Appl. No.: 09/121,854

[22] Filed: Jul. 24, 1998

[30] Foreign Application Priority Data

Nov. 17, 1997 [KR] Rep. of Korea ..... 97-60619

[51] Int. Cl.[7] ..... G06F 15/00

[52] U.S. Cl. ..... 358/1.14; 358/1.15

[58] Field of Search ..... 358/1.14, 1.15, 358/1.18, 1.13, 1.12, 1.4, 1.1, 498, 496, 406; 347/104; 346/134; 399/23, 381; 400/624, 629, 703; 271/160, 152, 154, 155, 258.01, 110, 118; 242/563; 335/205; 116/67 A; 177/46

[56] References Cited

U.S. PATENT DOCUMENTS

| | | | |
|---|---|---|---|
| 4,204,180 | 5/1980 | Usui et al. | 335/205 |
| 4,422,402 | 12/1983 | Ogihara | 116/67 A |
| 4,508,332 | 4/1985 | Nishio | 271/118 |
| 4,535,463 | 8/1985 | Ito et al. | 271/155 |
| 4,566,547 | 1/1986 | Furukawa | 177/46 |
| 4,734,747 | 3/1988 | Okuda et al. | 399/23 |
| 5,053,814 | 10/1991 | Takano et al. | 399/23 |
| 5,096,180 | 3/1992 | Nagaoka et al. | 271/110 |
| 5,177,544 | 1/1993 | Kimura et al. | 346/134 |
| 5,700,003 | 12/1997 | Sung | 271/110 |
| 5,812,280 | 9/1998 | Kwan-Bo | 358/406 |
| 5,820,068 | 10/1998 | Hosomi et al. | 242/563 |
| 5,884,861 | 3/1999 | Hosomi et al. | 242/563 |

*Primary Examiner*—Dov Popovici
*Attorney, Agent, or Firm*—Sughrue, Mion, Zinn, Macpeak & Seas, PLLC

[57] ABSTRACT

An apparatus for detecting the amount of paper remaining in a paper cassette of a printer is provided. The apparatus includes a spring elastically biasing the base plate upward at an opposite side from a hinged side, a rack gear installed on the bottom surface of the base plate extending downward, a pinion gear rotating interlockingly with the vertically movement of the rack gear, a variable resistor providing variable resistance values through two fixed terminals according to the rotation positions of the pinion gear, a voltage signal generator connected to the terminals, for generating voltage signals corresponding to the resistance value of the terminals, and a paper amount determining unit for reading the voltage signal to determine the amount of papers in the base plate, and outputting information on the amount of paper remaining. Thus, information on the amount of remaining paper can be sent to a remote user away from the printer display through a communications network connected thereto.

10 Claims, 2 Drawing Sheets

APPARATUS FOR DETECTING AMOUNT OF PAPER REMAINING IN PAPER CASSETTE OF PRINTER

BACKGROUND OF THE INVENTION

1. Field of the Invention

The present invention relates to an apparatus for detecting the amount of paper remaining in a cassette of a printer and, more particularly, to an apparatus for detecting the amount of paper remaining in a cassette of a printer in which the remaining paper information is obtained as an electrical signal, to show the information by sending the information to a printer display and/or computer connected to a printer.

2. Description of the Related Art

In a typical electrophotographic printer such as a laser printer or a copying machine, an electrostatic latent image is formed on a photosensitive medium by exposure, and an image obtained from the electrostatic latent image developed by a developing material is transferred to a paper to print a desired image.

In the above printer, a paper cassette is provided for storing papers capable of moving into or out of a main body of the printer.

When there is no paper in the paper cassette, printing cannot be performed. Thus, before printing, the paper cassette is checked using a separate sensor to detect whether there is paper in the paper cassette or not, or by using a sensor for detecting whether paper to be supplied to a printing unit passes through a paper transferring path. In the case of using a sensor for detecting whether the paper passes through the paper transferring path, a paper feeding roller for feeding the paper of the paper cassette is driven, and then when a paper passing signal is not output from the sensor at a predetermined time, the printing is stopped. Meanwhile, when there is no paper in the paper cassette, a system controller sends a signal or a message on a display installed on an operation panel informing the user.

However, in the conventional technology, information on the amount of paper remaining cannot be obtained before exhaustion of paper.

A display may be provided in one side of the paper cassette to show the amount of paper remaining without opening the paper cassette. However, a remote user away from a printer or a user using the printer through a network must go to the printer to check the amount of paper remaining.

SUMMARY OF THE INVENTION

To solve the above problem, it is an objective of the present invention to provide an apparatus for detecting the amount of paper remaining in a paper cassette of a printer capable of informing a remote user of information on the amount of paper remaining.

Accordingly, to achieve the above objective, there is provided an apparatus for detecting the amount of paper remaining in a paper cassette of a printer including a case and a base plate hinged at one side of the case, comprising;

a spring disposed between the case and the base plate to elastically bias the base plate upward at an opposite side from the hinged side;

a rack gear installed on the bottom surface of the base plate extending downward a predetermined length;

a pinion gear rotating interlockingly with the vertically movement of the rack gear;

a variable resistor having a resistance element rotating interlockingly with the rotation of the pinion gear for providing variable resistance values through two fixed terminals according to the rotation positions of the resistance element;

a voltage signal generator connected to the terminals, for generating voltage signals corresponding to the resistance value of the terminals; and a paper amount determining unit for reading the voltage signal to determine the amount of paper in the base plate, and outputting information on the amount of paper remaining.

BRIEF DESCRIPTION OF THE DRAWINGS

The above objective and advantages of the present invention will become more apparent by describing in detail a preferred embodiment thereof with reference to the attached drawings, in which.

DETAILED DESCRIPTION OF THE PREFERRED EMBODIMENTS

Figure 1:
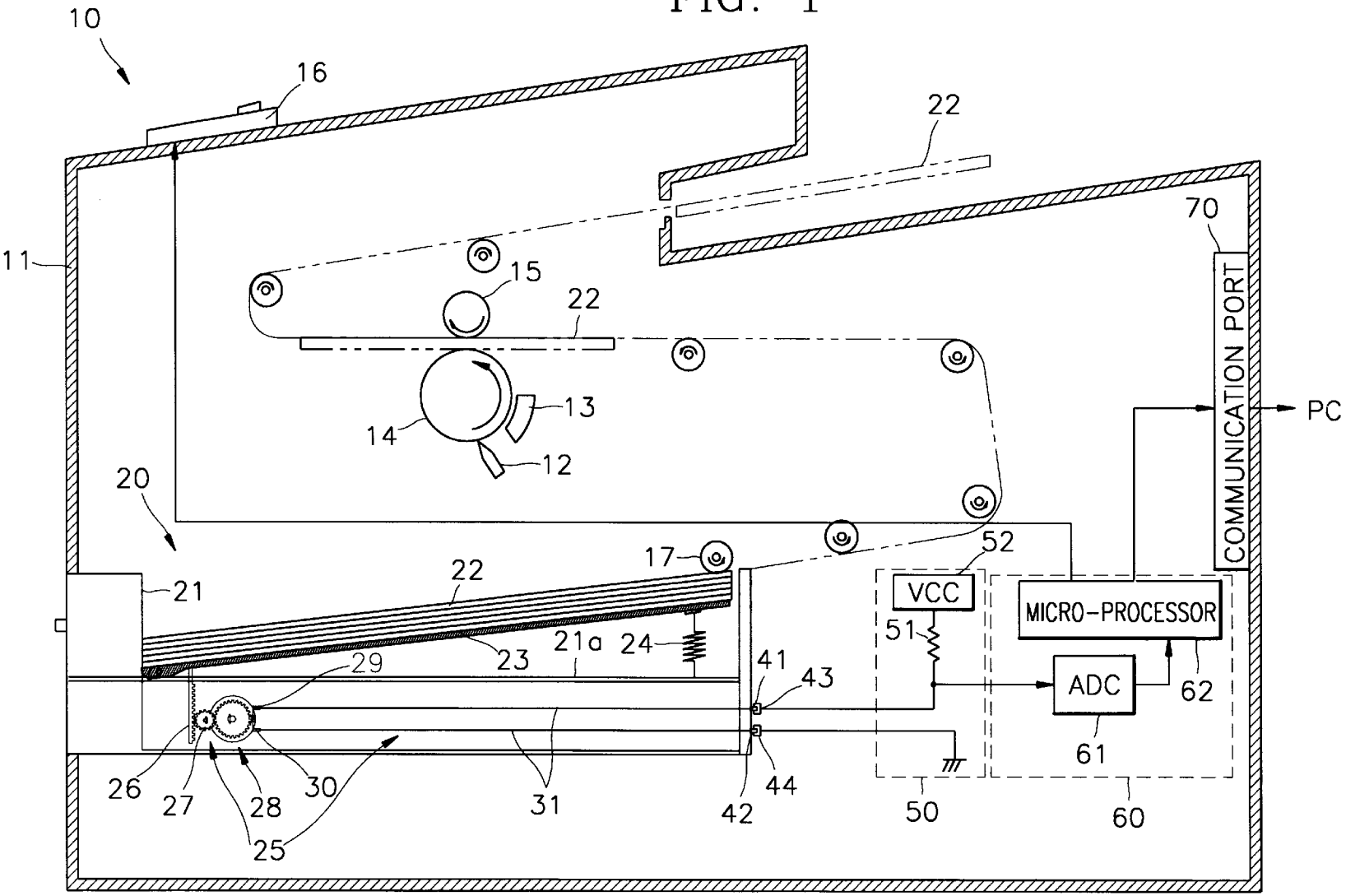
FIG. 1 is a sectional view showing a printer adopting a paper remaining detector in a paper cassette according to the present invention.
Figure 2:
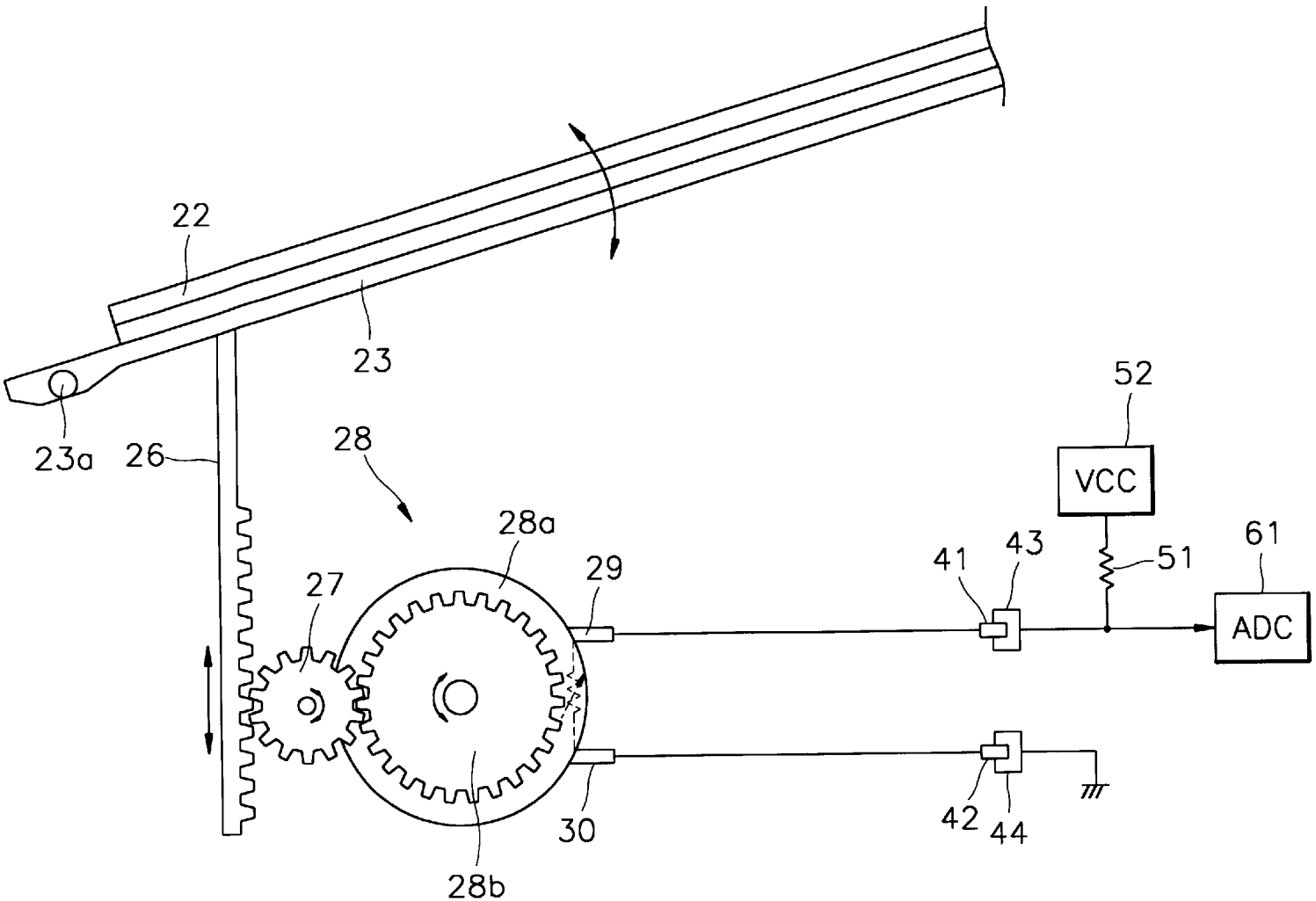
FIG. 2 is an enlarged sectional view of portions of a paper remaining detector.

Referring to FIGS. 1 and 2, a printer 10 includes a paper cassette 20, a paper feeding roller 17, a photosensitive drum 14, a pressure roller 15, a laser scanning unit 12 and a developing unit 13.

The paper cassette 20 capable of moving into and out of a main body 11 of the printer 10 is comprised of a case 21, a base plate 23 hinged at one side of the case 21, and a spring 24 installed to elastically bias the base plate 23 upward from a bottom surface 21*a* of the case 21.

The elastic bias of the spring 24 enables paper 22 to contact the paper feeding roller 17, irrespective of the amount of the paper remaining.

In paper cassette 20, the slope of the base plate 23 from the bottom surface 21*a* is changed by the amount of paper stacked on the base plate 23.

Using the above principle, a rack gear 26 is installed on the bottom surface of the base plate 23 in order to obtain information of vertical movement of the base plate 23 according to a change in the amount of paper 22. A pinion gear 27 changing rectilinear movement into rotary movement being in engagement with the rack gear 26 is installed in a space 25 under the bottom surface 21*a* of the case 21.

Also, a variable resistor 28 includes a first rotation gear 28*b* being in engagement with the pinion gear 27, a resistor body 28*a* being formed of a single body with the first rotation gear 28*b* and two terminals 29 and 30 contacting an outer surface of the resistor body 28*a* in fixed positions to determine a resistance value. The resistor body 28*a* supplies various values between the terminals 29 and 30 according to the rotation position. For instance, the resistor body 28*a* from a surface to a center may be formed of resistance layers of radially various thicknesses, and the surface of the resistor body 28*a* which is not positioned within a space between the two terminals 29 and 30 may be partially formed of an insulation layer. The variable resistor 28 supplies resistance values through the ends of the terminals 29 and 30 according to the rotation of the pinion gear 27.

A voltage signal generator 50 for generating a voltage signal corresponding to the resistance value from the terminals 29 and 30 includes a direct current (DC) power supply 52 connected to the terminals to supply a current path between the two terminals 29 and 30, and a fixed resistor 51. A voltage signal between the two terminals 29 and 30 is output to an analog-to-digital converter (ADC) 61.

Here, in a state in which the paper cassette 20 is installed in the main body 11 of the printer 10, both terminals 29 and 30 of the variable resistor 28 are connected to terminals 41 and 42 protruding from an end of the case 21 through wires 31. When the paper cassette 20 is installed in the main body 11 of the printer 10, connection terminals 43 and 44 are provided in the main body 11 of the printer 10 to be connected to the terminals 41 and 42, by male and female connectors or other means adequate to provide an electrical connection. This arrangement provides an electrical circuit connection of the variable resistor 28 and the voltage signal generator 50.

A calculating portion 60 includes an analog-to-digital converter 61 for converting a voltage signal received from the voltage signal generator 50 into a digital signal, and a microprocessor 62 for reading the digital signal to determine the amount of paper in the paper cassette 20.

The microprocessor 62 reads the input digital signal to determine the amount of paper in the paper cassette 20. The microprocessor 62 outputs information on the amount of paper to the display 16. The information is supplied to a personal computer (PC) connected through a communications port 70, if desired. Meanwhile, when it is determined that there is no paper, preferably, the microprocessor 62 is programmed to send a message of printing stop and asking the user to supply paper 22 to the display 16 and to the PC connected through the communications port 70.

According to the apparatus for detecting information on the amount of paper remaining in the paper cassette of a printer, the remaining paper information can be sent to a remote user far away through the connected communications network.

It is understood that, in an alternative embodiment, the first rotation gear **28*b* may be in direct communication with rack gear 26. This allows for the omission of the pinion gear 27**.

It is contemplated that numerous modifications may be made to the apparatus for detecting amount of paper remaining in a paper cassette of the present invention without departing from the spirit and scope of the invention as defined in the following claims.

What is claimed is:

1. An apparatus for detecting the amount of paper remaining in a paper cassette of a printer including a case and a base plate hinged at one side of the case, comprising:

a spring disposed between the case and the base plate to elastically bias the base plate upward at an opposite side from the hinged side;

a rack gear installed on a bottom surface of the base plate extending downward a predetermined length;

a pinion gear rotating interlockingly with the vertical movement of the rack gear;

a variable resistor having a resistance element rotating interlockingly with the rotation of the pinion gear for providing variable resistance values through two fixed terminals according to the rotation positions of the resistance element;

a voltage signal generator connected to the terminals, for generating voltage signals corresponding to the resistance value of the terminals; and a paper amount determining unit for reading the voltage signal to determine the amount of paper in the base plate, and outputting information on the amount of paper remaining.

2. The apparatus of claim 1, wherein the paper amount determining unit comprises:

an analog-to-digital converter for converting the voltage signal to a digital signal; and a microprocessor for reading the digital signal to determine the amount of paper remaining.

3. The apparatus of claim 1, wherein the voltage signal generator comprises:

a direct current (DC) voltage source; and a fixed resistor having two ends, one end connected to the DC voltage source;

wherein the other end of the fixed resistor is connected to one of the two fixed terminals to output the potential thereof, and the other fixed terminal is connected to ground to form a current path.

4. An apparatus for detecting the amount of paper remaining in a paper cassette including a case and a base plate hinged at one side of the case, comprising:

a spring elastically biasing the base plate upward at an opposite side from the hinged side;

a rack gear installed on a bottom surface of the base plate extending downward a predetermined length;

a pinion gear rotating interlockingly with the vertical movement of the rack gear;

a variable resistor providing variable resistance values according to the rotation position of the pinion gear;

a voltage signal generator connected to the variable resistor, for generating voltage signals corresponding to said variable resistance values; and a paper amount determining unit for determining the amount of paper in the base plate, based on said voltage signals.

5. The apparatus of claim 4, wherein the paper amount determining unit comprises:

an analog-to-digital converter for converting the voltage signal to a digital signal; and a microprocessor for reading the digital signal to determine the amount of paper remaining.

6. The apparatus of claim 4, wherein the voltage signal generator comprises:

a direct current (DC) voltage source; and a fixed resistor having two ends, one end connected to the DC voltage source;

wherein the other end of the fixed resistor is connected to one of two fixed terminals to output the potential thereof, and the other fixed terminal is connected to ground to form a current path.

7. The apparatus of claim 4, wherein the apparatus is for use with a printer.

8. The apparatus of claim 7, wherein the paper amount determining unit comprises:

an analog-to-digital converter for converting the voltage signal to a digital signal; and a microprocessor for reading the digital signal to determine the amount of paper remaining.

9. The apparatus of claim 7, wherein the voltage signal generator comprises:

a direct current (DC) voltage source; and a fixed resistor having two ends, one end connected to the DC voltage source;

wherein the other end of the fixed resistor is connected to one of two fixed terminals to output the potential thereof, and the other fixed terminal is connected to ground to form a current path.

10. The apparatus of claim 4, wherein the variable resistor comprises a rotation gear which is engaged with the pinion gear, a resistor body formed integrally with the rotation gear, and two terminals which contact an outer surface of the resistor body.

* * * * *